US008492628B2

(12) United States Patent
Ruan

(10) Patent No.: US 8,492,628 B2
(45) Date of Patent: Jul. 23, 2013

(54) VIOLIN SHOULDER CRADLE

(76) Inventor: Ying Gang Ruan, Overland Park, KS (US)

( * ) Notice: Subject to any disclaimer, the term of this patent is extended or adjusted under 35 U.S.C. 154(b) by 0 days.

(21) Appl. No.: 13/235,216

(22) Filed: Sep. 16, 2011

(65) Prior Publication Data

US 2012/0006176 A1 Jan. 12, 2012

Related U.S. Application Data

(62) Division of application No. 12/415,833, filed on Mar. 31, 2009, now Pat. No. 8,022,280.

(51) Int. Cl.
*G10D 1/02* (2006.01)

(52) U.S. Cl.
USPC ..... 84/279

(58) Field of Classification Search
USPC ..... 84/278, 279, 280; D17/20
See application file for complete search history.

(56) References Cited

U.S. PATENT DOCUMENTS

| | | | | |
|---|---|---|---|---|
| 156,613 | A | 11/1874 | White | |
| 217,330 | A | 7/1879 | Bull | |
| 550,386 | A | 11/1895 | Davis | |
| 576,950 | A | 2/1897 | Coloney | |
| 2,652,739 | A * | 9/1953 | Hall | 84/280 |
| 4,333,378 | A * | 6/1982 | Hrdlicka | 84/280 |
| 5,415,070 | A | 5/1995 | Kaman | |
| 5,883,315 | A | 3/1999 | Kaplan et al. | |
| 6,031,163 | A | 2/2000 | Cullum et al. | |
| 6,278,044 | B1 * | 8/2001 | Ruan | 84/279 |
| 6,756,531 | B2 | 6/2004 | Ruan | |
| 7,064,258 | B2 | 6/2006 | Mea | |
| 7,368,645 | B2 * | 5/2008 | Armstrong et al. | 84/278 |
| 7,476,789 | B1 * | 1/2009 | Federici | 84/279 |

OTHER PUBLICATIONS

Shar Holiday Gift Guide, (serving string musicians since 1962), "Now through Jan. 8, 2000," 4 selected pages, including cover, back cover, p. 23, and unnumbered page, Shar Products Company, Ann Arbor, Michigan.

* cited by examiner

*Primary Examiner* — Jianchun Qin
(74) *Attorney, Agent, or Firm* — Hovey Williams LLP

(57) ABSTRACT

A violin shoulder cradle is provided which provides for compact storage and for adjustment of the position of the violin to which the cradle is clamped relative to the shoulder of the wearer. The shoulder cradle hereof includes a base including a pair of clamping legs which are pivotally mounted to the base for movement between a retracted storage position and an extended violin-clamping position. It further includes a connection between the base which may include an array of studs and a corresponding grid pattern or matrix of tubes in a receiver, and/or at least one magnet which magnetically holds the foundation to the base.

10 Claims, 13 Drawing Sheets

VIOLIN SHOULDER CRADLE

This application is a divisional of application Ser. No. 12/415,833, filed Mar. 31, 2009, the entire disclosure of which is incorporated herein by reference.

BACKGROUND OF THE INVENTION

1. Field of the Invention

The present invention concerns a shoulder cradle useful for holding a stringed instrument such as a violin on the users shoulder. More particularly, it is concerned with a shoulder cradle which includes pivotally mounted retaining legs which partially retract, and an improved mounting system which enables the shoulder rest to be adjustably mounted relative to its base in order to promote improved positioning for the wearer.

2. Description of the Prior Art

Violins, violas and like stringed instruments are typically played by placing the body of the instrument on the shoulder of the musician and held between the musician's shoulder and chin. A variety of different supports have heretofore been used which attach to the violin body and cushion or position the violin on the wearers shoulders.

Such supports include those shoulder cradles which I have previously developed as shown in U.S. Pat. Nos. 6,278,044 and 6,756,531, the entire disclosures of which are incorporated herein by reference. Those shoulder cradles represent a substantial advance in ergonomics as applied to such shoulder mounted stringed instruments as violins and violas, in that those shoulder cradles demonstrate the ability of the shoulder cradle to conform more closely to human anatomy, thereby reducing fatigue on the musician, while securely clamping to the stringed instrument.

While my prior shoulder cradles present a substantial advance in the art, it is to be recognized that each musician is different, both in size and technique. Thus, I have found a need for a shoulder cradle which is more adaptable to different musicians. In addition, I have found that there is a need for improved portability of the shoulder cradle while retaining the ability to firmly clamp to the instruments so as to avoid unintended shifting of the instrument relative to the shoulder cradle. Both of these improvements need to take into account the need for economical construction which will require a minimum of maintenance by the musician.

SUMMARY OF THE INVENTION

These objects have largely been achieved by the improved violin shoulder cradle of the present invention. That is to say, the present invention retains the benefits of my earlier designs by conforming to the shoulder configuration of the wearer, requiring only minimal involvement by the musician, and including a layer of padding, while being redesigned for improved portability and storage as well as adjustability for better fitting to the body and technique of different musicians.

Broadly speaking, the shoulder cradle of the present invention includes many of the same features of U.S. Pat. Nos. 6,278,044 and 6,756,531 in that it includes a shoulder support including a base and a foundation, and coupling structure associated with the base which includes gripping legs. The foundation body includes a cushion and preferably conforms to the shoulder of the musician. The gripping legs are in turn coupled to a base plate for securely holding a stringed instrument such as a viola or violin. However, at least one, and preferably two of the gripping legs are pivotally mounted relative to the base plate, which is attached to a mounting plate and together with the base plate presents recesses for receiving at least a part of the respective pivoting leg or legs to be received between the base plate and the mounting plate. The base includes shoulders which limit the pivoting movement of the pivoting legs, thereby ensuring that when those legs engage the shoulder, they impart a biasing force to the instrument for holding it securely to the base.

In addition, the present invention preferably includes a coupling between the base and the foundation, so that the foundation may be repositioned relative to the base for purposes of adjustment to accommodate more precisely the needs of different musicians. The coupling preferably permits the base to be relocated relative to the foundation without the need for tools. Moreover, most preferably the coupling permits the base to be adjusted relative to the foundation along at least one, and preferably two axes. Thus, the musician may shift the position of the base relative to the foundation, and consequently adjust or reposition the instrument relative to his or her body, in order to provide the greatest degree of comfort and suitability to the musician's technique. In the preferred embodiment, this repositioning is accomplished by the use of a coupling which includes complementally arrayed studs and tubes arranged in a grid-type pattern such that when the studs are inserted into the tubes, the sides of the tubes grip and hold the studs. This arrangement permits the foundation to be shifted relative to the base along two different axes. The present invention may alternatively, or in addition, include additional structure to retain (when desired) the foundation in connection with the base, and thus inhibit undesired separation of the base and foundation. Most preferably, this retaining structure is provided by magnetic coupling including one or more magnets are provided in either the foundation or base, and a corresponding member of ferromagnetic material is provided in the other of the foundation and base. As shown in the preferred embodiment, a plurality of small magnets may be provided in the studs for magnetic coupling with a ferromagnetic member in the foundation positioned proximate to the magnets when the base and foundation are coupled. Thus, in the most preferred embodiment, the musician may detach, reposition, and reattach the base and foundation without the need for tools, and without disassembly of the shoulder cradle.

The shoulder cradle hereof further permits the violin or other stringed instrument to be moved on the musician's shoulder during performance while the cradle remains on the wearer's shoulder. The shoulder cradle may include a shoe which includes slots, preferably arcuate slots, so that the base may be pivoted relative to the foundation. This provides further comfort for the musician and support for the violin while permitting the musician to shift or pivot the violin while it is played. The shoe is further capable of adjustment in mounting the base and the foundation, so that the musician may optimally position the violin on the shoulder and still be able to pivot the violin while playing.

These and other advantages will be readily apparent to those skilled in the art with reference to the drawings and description as further recited below.

DESCRIPTION OF THE PREFERRED EMBODIMENT

Figure 1:
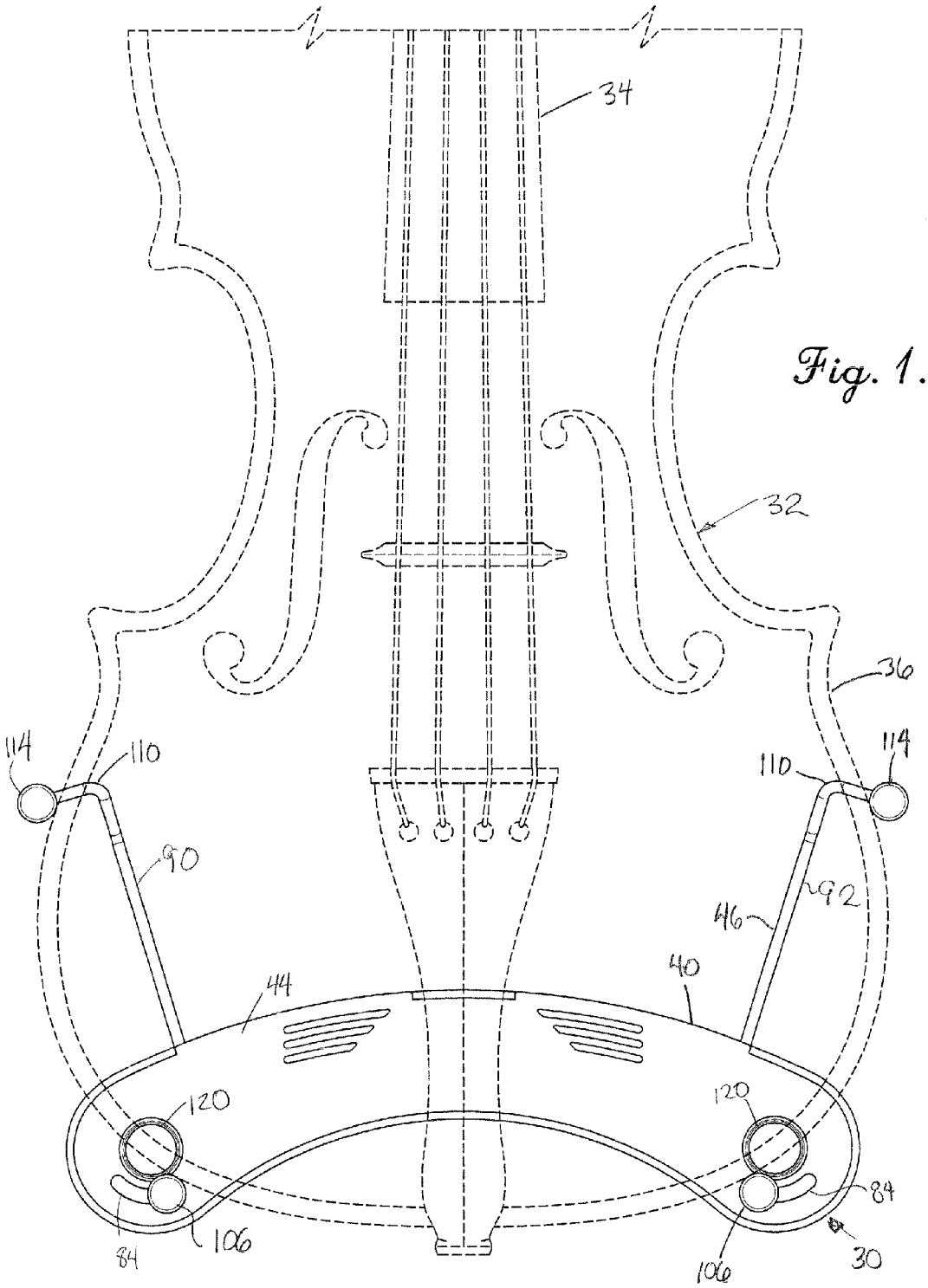
FIG. 1 is a top plan view of my violin shoulder cradle when in a position for use, showing the legs of the coupling structure clamped to a violin which is shown in broken lines to view the shoulder cradle.

Referring now to the drawing, a violin shoulder cradle 30 is shown coupled to a violin 32. As used herein, "violin" is intended to include similar instruments such as violins of reduced size, e.g. half or three-quarter sized violins, and violas, where the instrument is typically positioned between the shoulder and chin of the musician. The violin includes a neck 34 corresponding to a central longitudinal axis of the violin 32 and is normally positioned away from the neck of the musician, and a body 36. The body has a belly with a chin rest positioned on the belly, all as described in my U.S. Pat. No. 6,756,531, the disclosure of which pertaining to the violin is incorporated herein by reference.

Figure 2:
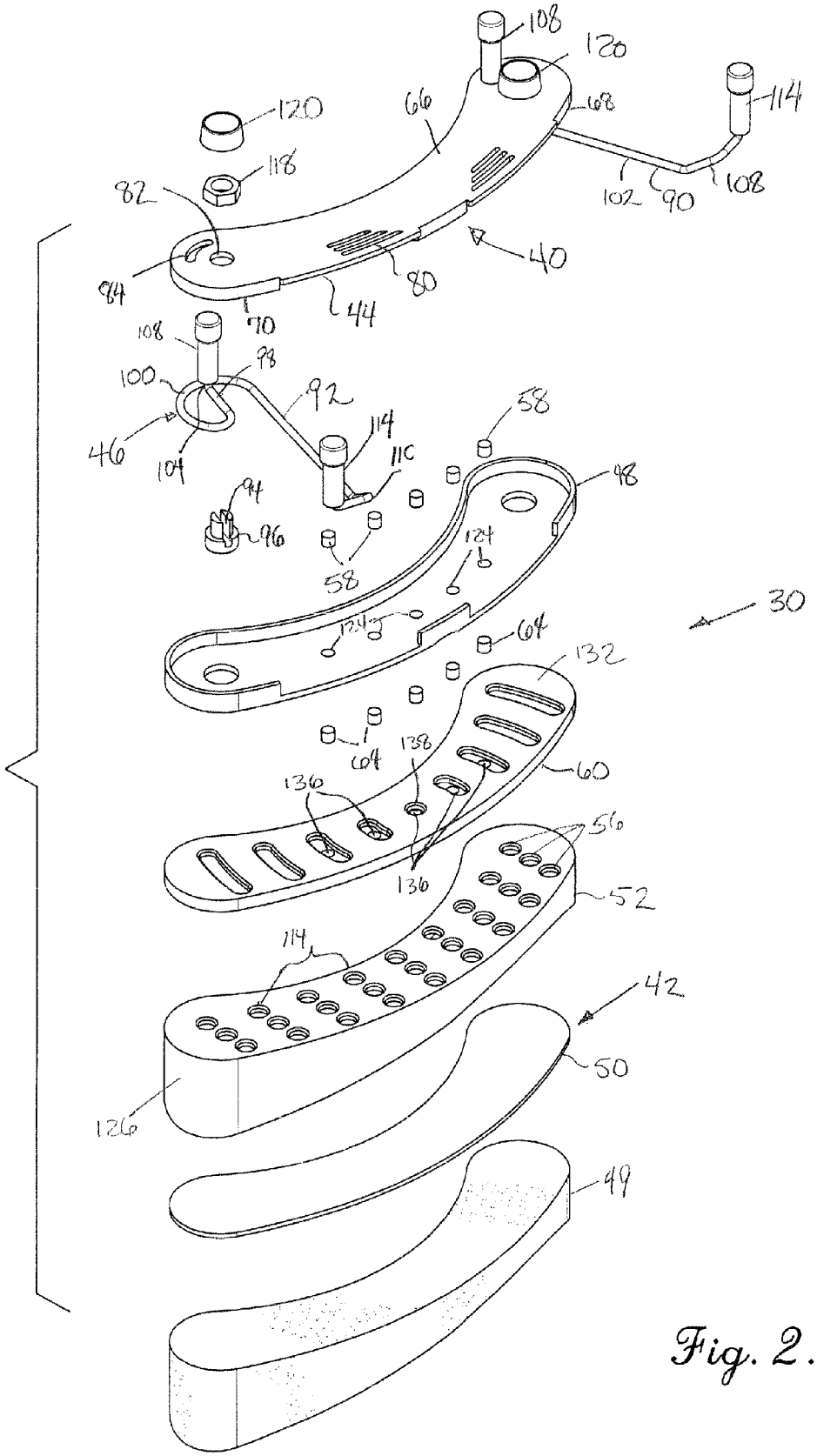
FIG. 2 is an exploded view viewed looking downwardly from the top side of the shoulder cradle when positioned in normal use with the violin above, showing the shoulder support including a base and a foundation including a ferromagnetic plate positioned between a receiver and a cushion.
Figure 3:
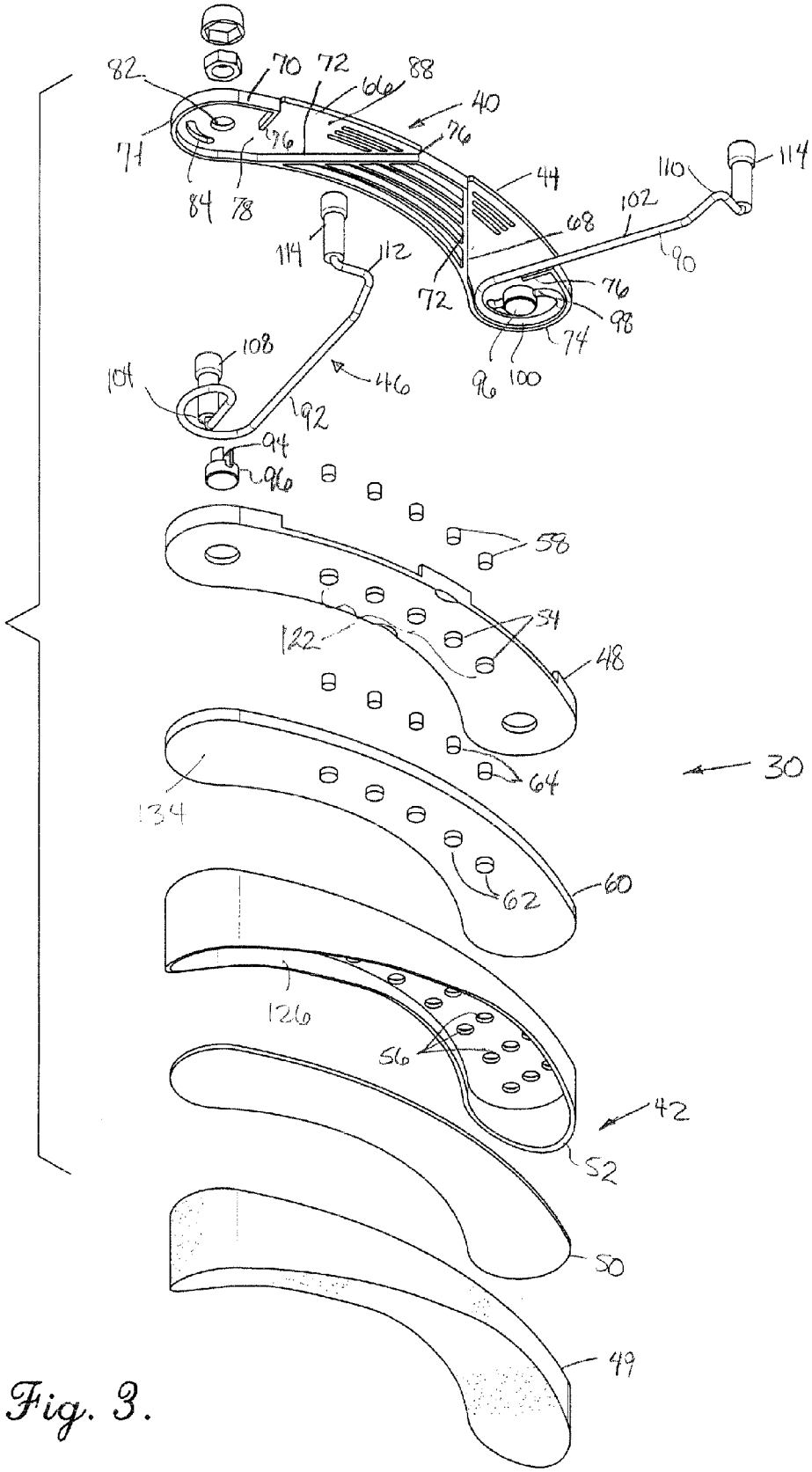
FIG. 3 is an exploded view similar to FIG. 2 but looking upwardly from the bottom side of the shoulder cradle when positioned in normal use with the violin above, showing the base having magnets for insertion into studs located on the mounting plate for receipt in corresponding tubes in a receiver of the foundation for attachment of the foundation to the base plate of the coupling structure.

As shown in greater detail in the exploded drawings of FIGS. 2 and 3, the cradle 30 of the present invention broadly includes a base 40 and a foundation 42 which make up a body having two parts which are removably connected together by connection structure. The base 40 preferably includes a base plate 44 which mounts coupling structure 46 to enable mounting the cradle 30 to the violin 32 as shown in FIG. 1, and a mounting plate 48. The foundation 42 preferably includes a cushion 49, a ferromagnetic plate 50, and a receiver 52. The connection structure includes studs 54 extending from the mounting plate 48 for receipt in corresponding tubes 56 of the receiver 52, and/or magnets 58 which may be located within the studs 54 and the ferromagnetic plate 50 of the foundation 42. FIG. 2 also shows an optional shoe 60 which includes pegs 62 and may include magnets 64 and which enables the base 40 and the coupling structure 46 mounted thereon to shift relative to the foundation, as discussed in greater detail below.

In greater detail, the base plate 44 can be molded of synthetic resin, or machined or otherwise formed in one piece and is configured in a generally arcuate shape in plan. The base plate 44 has a base panel 66 and a pair of walls 68 and 70 which are mirror images of one another. Cavities 130 are located in the base plate 44 between the base panel 66 and the mounting plate 48. The walls 68 and 70 each extend substantially perpendicular from an inner side of the base panel 66 and are arcuate in configuration around the longitudinal ends of the base plate 44. A diagonal wall 72 extends across the interior of the base panel 60 from one end of an arcuate section 74, and an inner wall 76 extends interiorly generally toward the diagonal wall 72 from another end of the arcuate section 74. However, the inner wall 76 extends only part of the distance toward the diagonal wall 72, leaving a first gap 78 therebetween. The base panel 66 may include lightening slots 80, and includes a pair of spaced apart holes 82 and arcuate slots 84 positioned adjacent the holes 82. The diagonal walls 72 each have an end 86, and a second gap 88 is provided between the end 86 of the diagonal wall 72 and the inner wall 76 as shown in FIG. 3, which provides access into the cavities 130.

Figure 4:
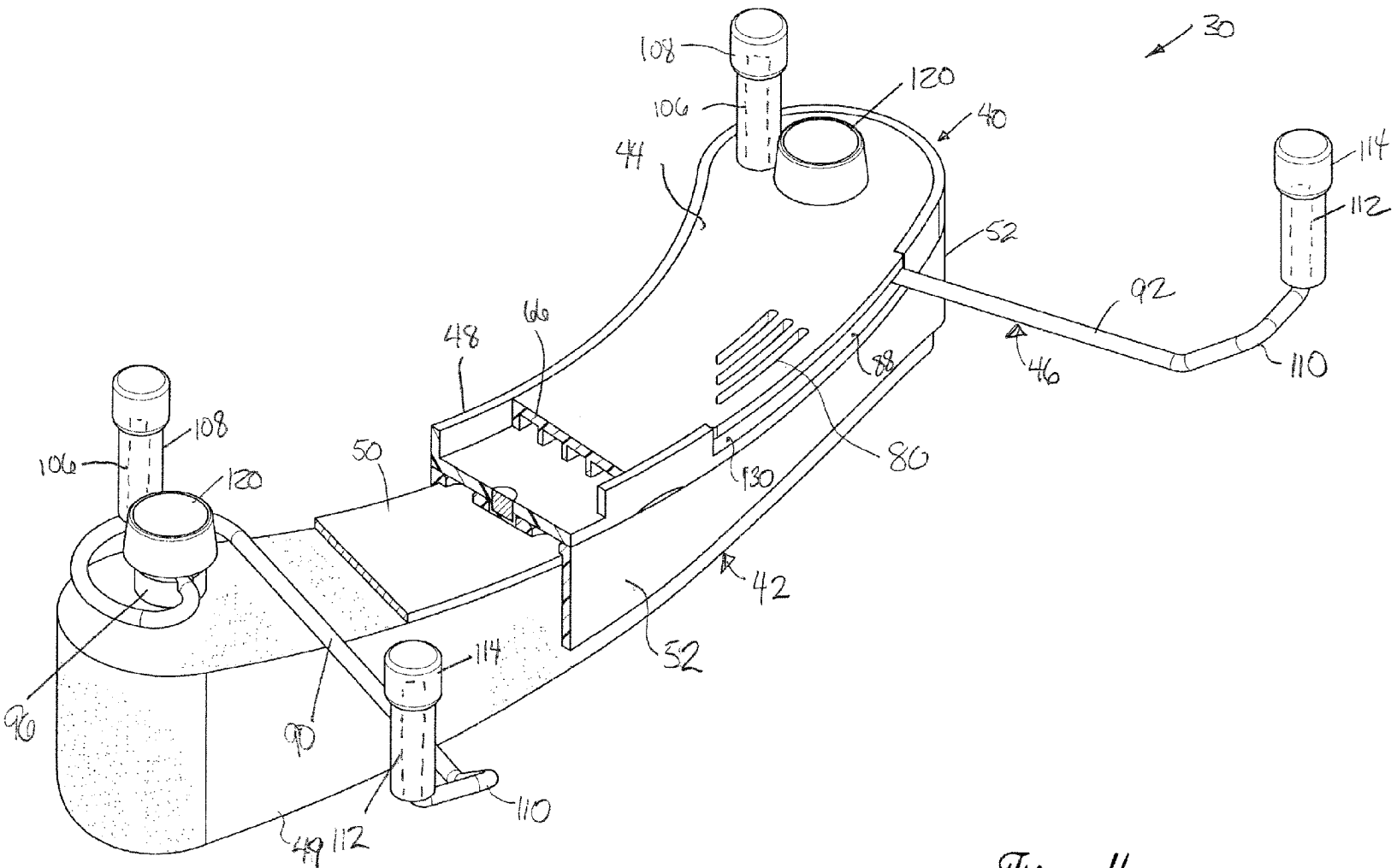
FIG. 4 is an enlarged top perspective view of the shoulder cradle hereof, with portions broken away for showing the coupling structure mounted to the shoulder support and one of the magnets positioned within one of the studs and located in proximity to a ferromagnetic plate on the foundation, and showing the legs of the coupling structure pivoted into position for mounting to a violin.

The coupling structure 46 includes legs 90 and 92 and pivot mounts 96. The legs 90 and 92 are received in slots 94 of pivot mounts 96 for pivoting relative to the base panel 66 of base plate 44. The legs 90 and 92 are preferably made of resilient wire which is bent as shown in FIGS. 2 and 3 to include a first straight section 98 which is received in the slots 94, an arcuate section 100 which most preferably extends through an arc of about 270 to 360 degrees to provide resiliency to a second straight section 102 which extends generally in the same direction as first straight section 98. A first terminal bend 104 ends in a first straight terminal section 106 (shown in broken lines in FIG. 4) which extends generally perpendicular to first straight section 98 and receives thereon a rubber or synthetic resin guard 108, and a second terminal bend 110 extends from second straight section 102 and ends in a second straight terminal section 112 (shown in broken lines in FIG. 4) which extends generally perpendicular to second straight section 102 and receives thereon a rubber or synthetic resin guard 114. The first straight terminal section passes through arcuate slot 84, with the synthetic resin guard 108 thus positioned above the base panel 66 in use. The arcuate section 100 of each of the legs 90 and 92 is thus positioned in the respective cavity 130 between the base plate 44 and the mounting plate 48. The pivot mounts 96 each have a threaded shank 116 in which resides the slot 94 for receiving the respective leg, the threaded shank 116 extending through a corresponding one of the holes 82 to receive nut 118 which is covered by a bumper 120 of rubber or synthetic resin to protect the violin 32. The pivot mounts 96 thus permit the second straight section 102 to pivot through their respective second gaps 88 between a retracted position as shown in FIGS. 5, 6 and 9 wherein most of the second straight section 102 is received in the cavity 130 between the base panel 66 and the mounting plate 48, and an extended position for clamping to a violin as shown in FIGS. 1, 4, 7, 8 and 10-20.

Figure 10:
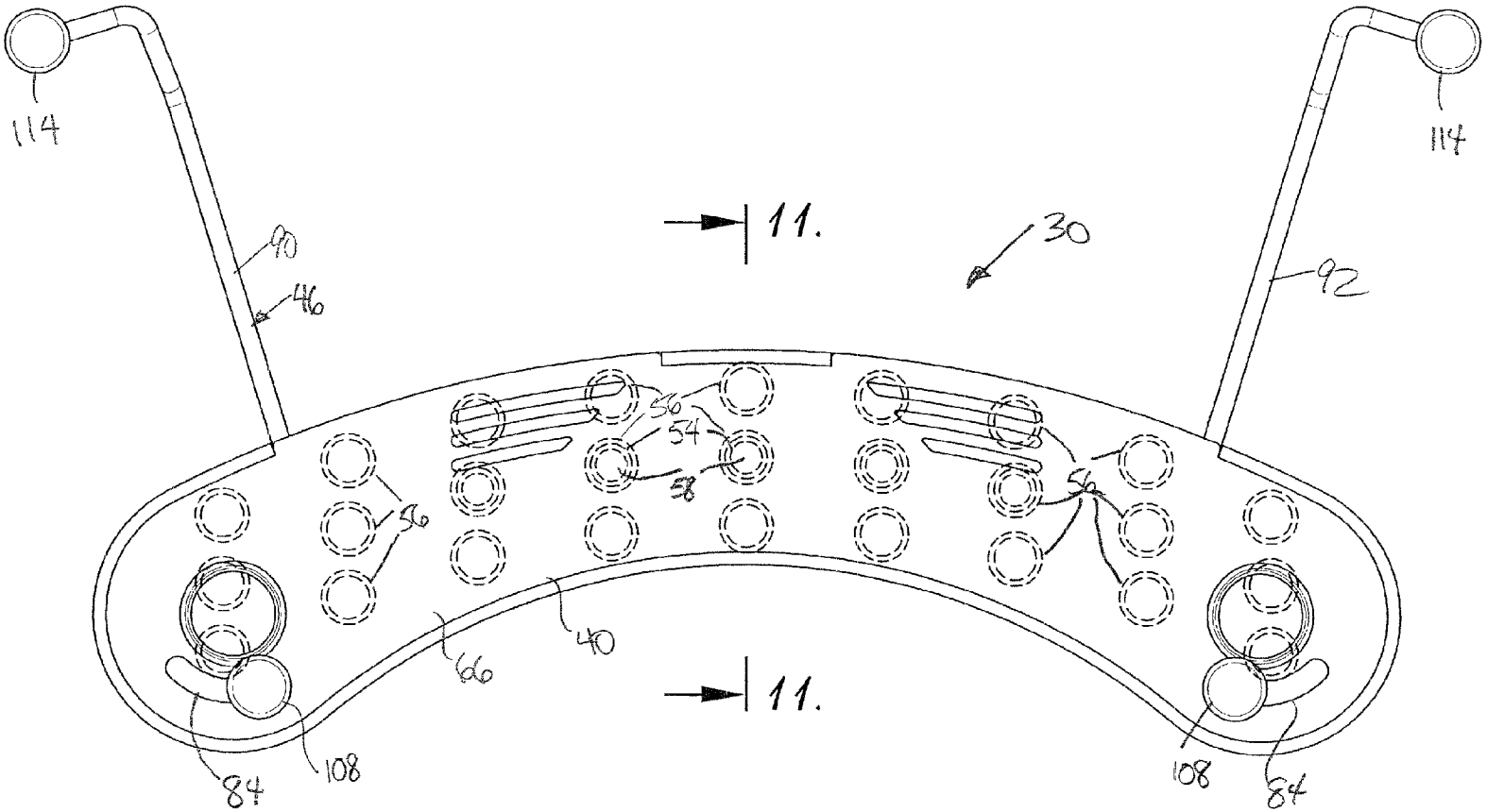
FIG. 10 is an enlarged top plan view of the shoulder cradle hereof, showing in broken lines the positions of the pins of the mounting plate with the magnets received therein, and corresponding holes in the receiver.
Figure 11:
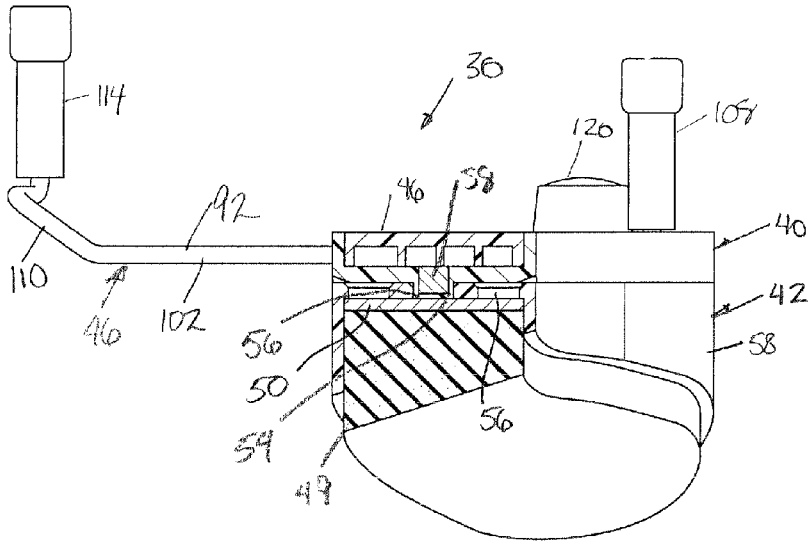
FIG. 11 is an enlarged side elevational view in partial vertical cross-section taken along line 11-11 of FIG. 10 showing the receipt of the pins of the mounting plate in the corresponding holes of the receiver and the location of one of the magnets proximate the ferromagnetic plate.

The mounting plate 48 includes a plurality of studs 54 which are presented preferably in a regularly spaced arrangement 122 as shown in FIGS. 3 and 10, for example, the spacing and arrangement of the studs 54 being complemental to that of the tubes 56 of the receiver 52. While the arrangement 122 may be linear or other pattern, it is more preferably somewhat arcuate to provide adjustability in greater conformance with how the cradle 30 rests on the shoulder of the violinist. The studs 54 have openings 124 which are sized to receive magnets 58 therein. Most preferably, a plurality of magnets 58 are provided, one magnet being received in each of the openings 124. Alternatively, the studs 54 can be omitted and the magnets 58 can be sized complemental to the tubes 56 and adhered or otherwise secured in the openings 124 to substitute for and serve as the studs 54.

Figure 12:
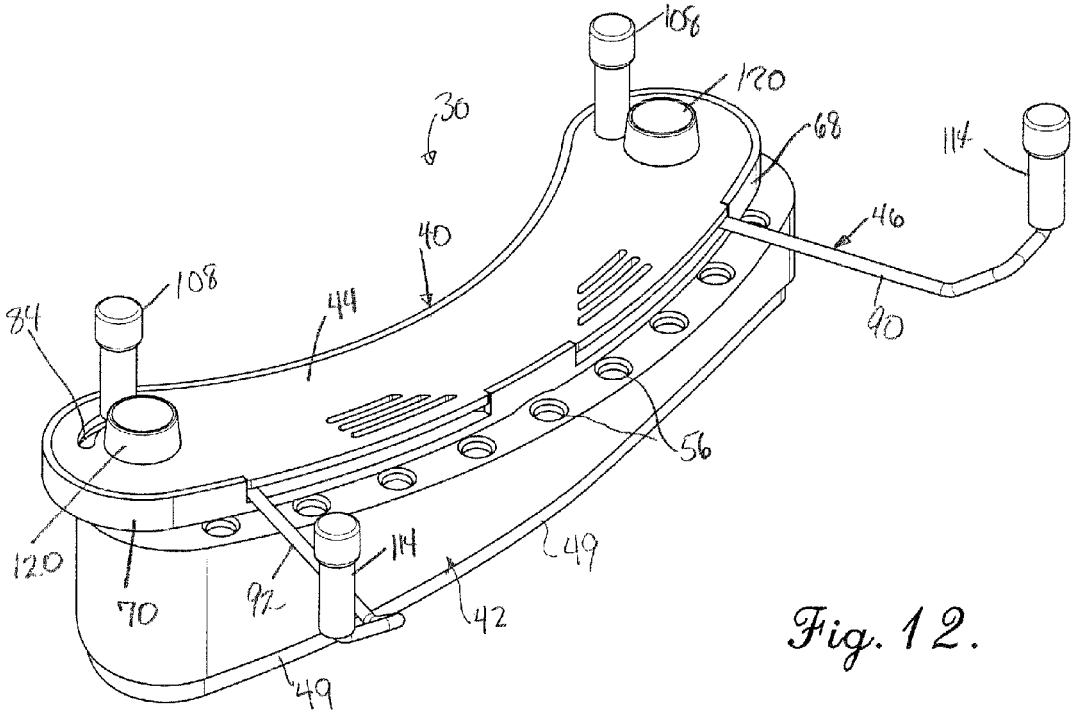
FIG. 12 is a perspective view of the shoulder cradle hereof showing the coupling structure offset relative to the foundation along an axis transverse to the longitudinal axis of the shoulder cradle.
Figure 13:
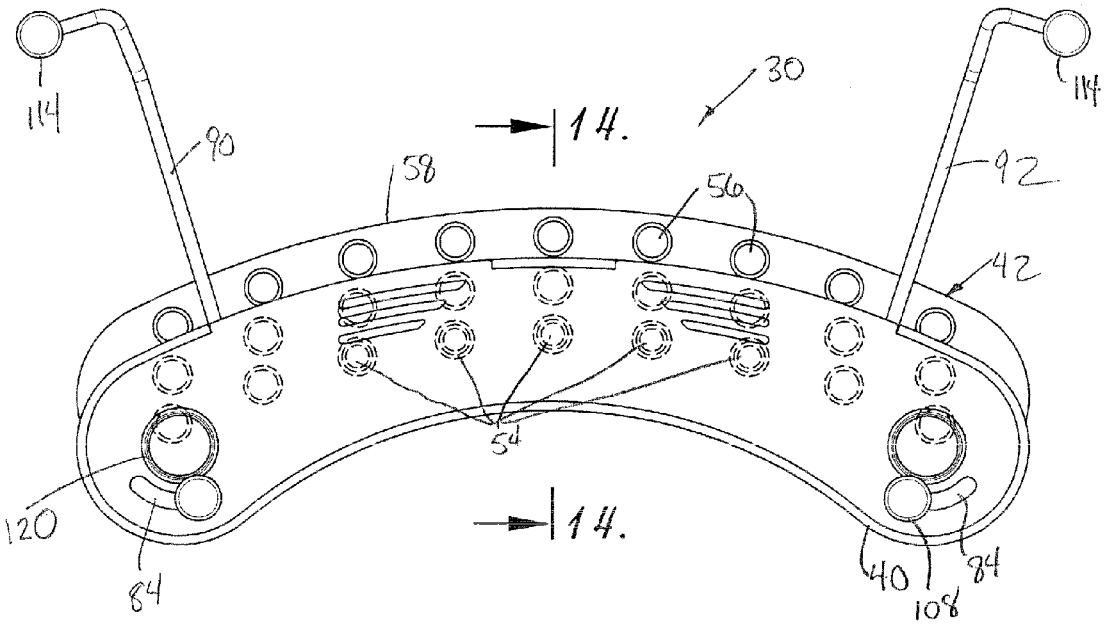
FIG. 13 is a top plan view of the shoulder cradle similar to FIG. 10 but with the coupling structure offset relative to the foundation as shown in FIG. 12.
Figure 14:
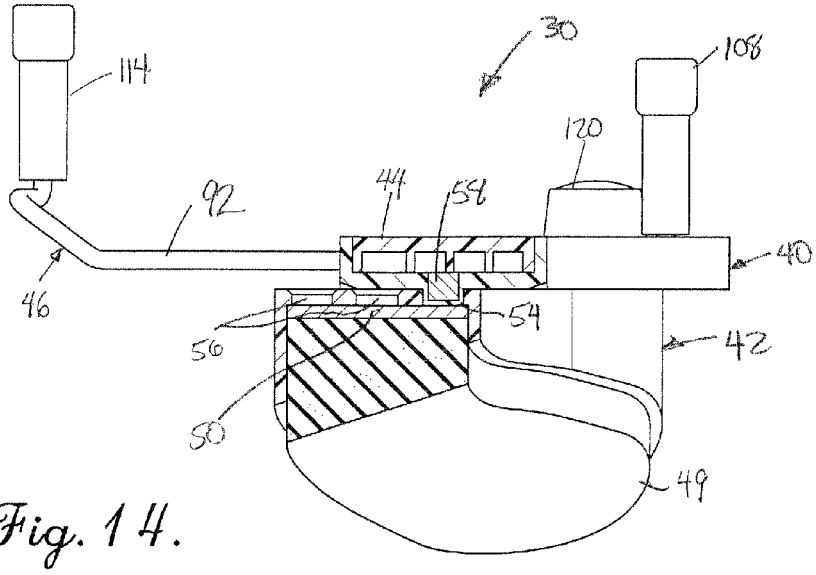
FIG. 14 is an enlarged side elevational view in partial vertical cross-section taken along line 14-14 of FIG. 13 and similar to FIG. 11 showing some of the pins received in corresponding recesses.
Figure 15:
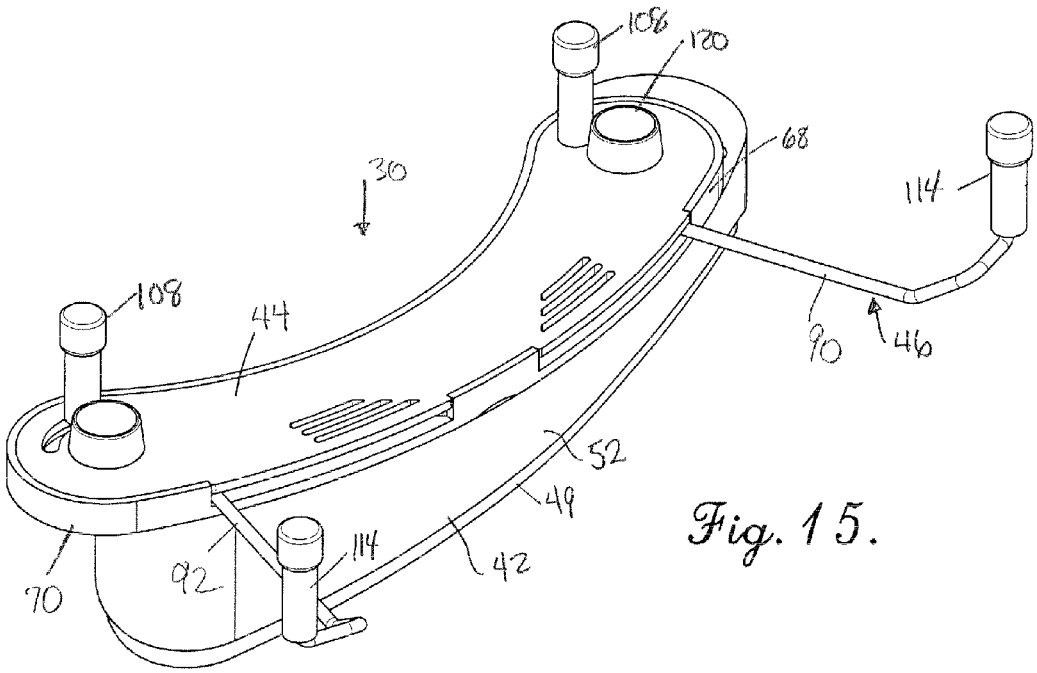
FIG. 15 is a perspective view of the shoulder cradle hereof but showing the coupling structure offset relative to the foundation along the longitudinal axis of the shoulder cradle.
Figure 16:
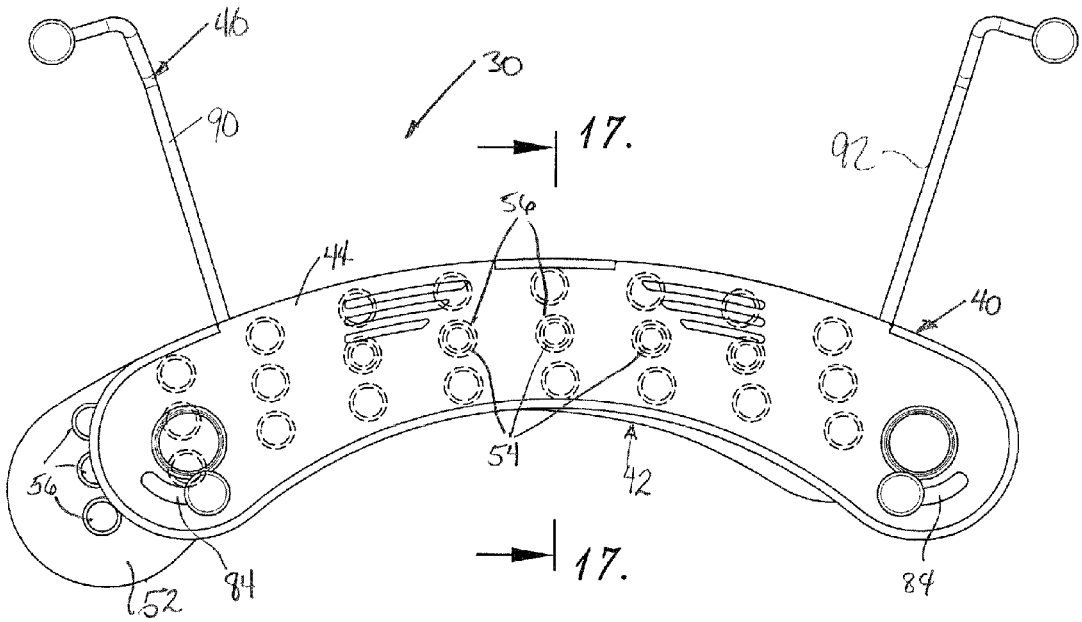
FIG. 16 is a top plan view of the shoulder cradle similar to FIG. 13 but with the coupling structure offset along its longitudinal axis relative to the foundation as shown in FIG. 15.
Figure 17:
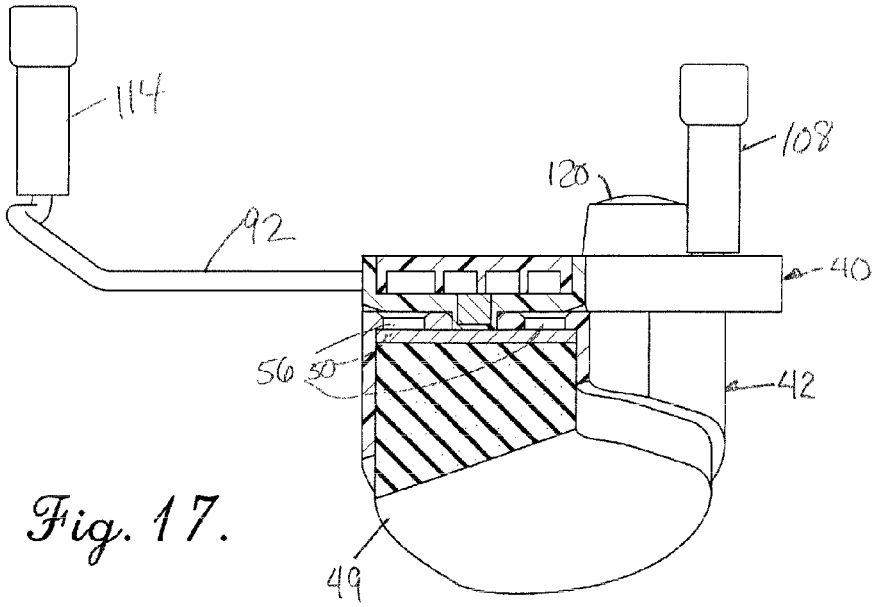
FIG. 17 is an enlarged side elevational view in partial vertical cross-section taken along line 17-17 of FIG. 16 and similar to FIGS. 11 and 14 but showing the pins received in the corresponding recesses when the coupling structure is shifted longitudinally relative to the foundation.
Figure 20:
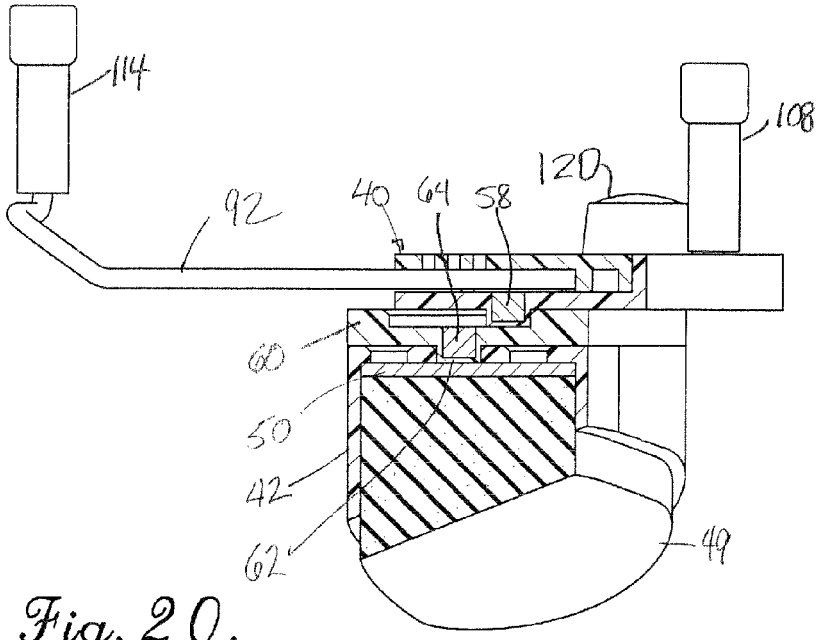
FIG. 20 is a vertical cross-sectional view taken along line 20-20 of FIG. 19, showing the coupling between the foundation, shoe and base.
Figure 18:
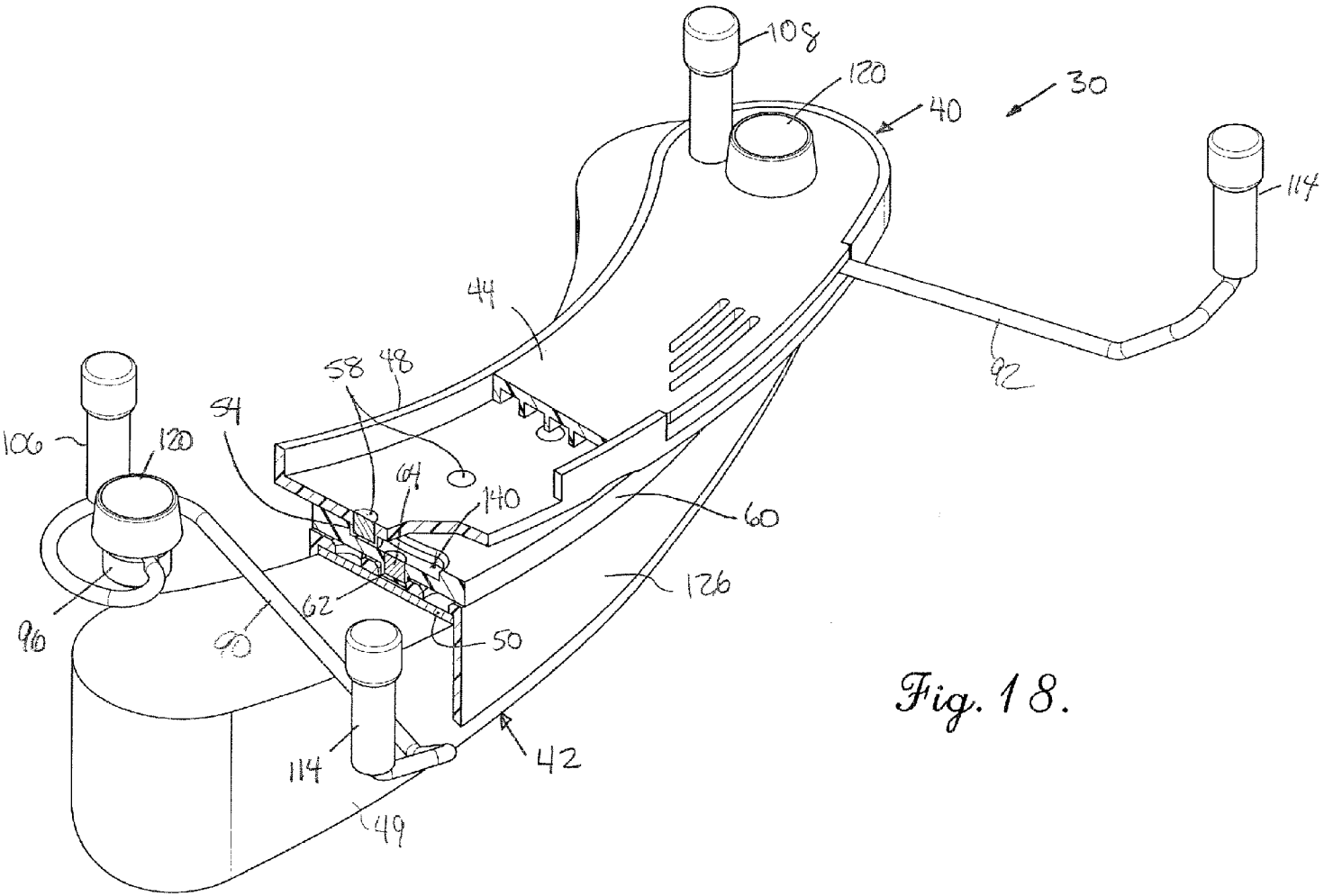
FIG. 18 is a perspective view similar to FIG. 4 with portions broken away for clarity, wherein a shoe enabling relative movement of the base and the foundation is positioned between the foundation and the base.
Figure 19:
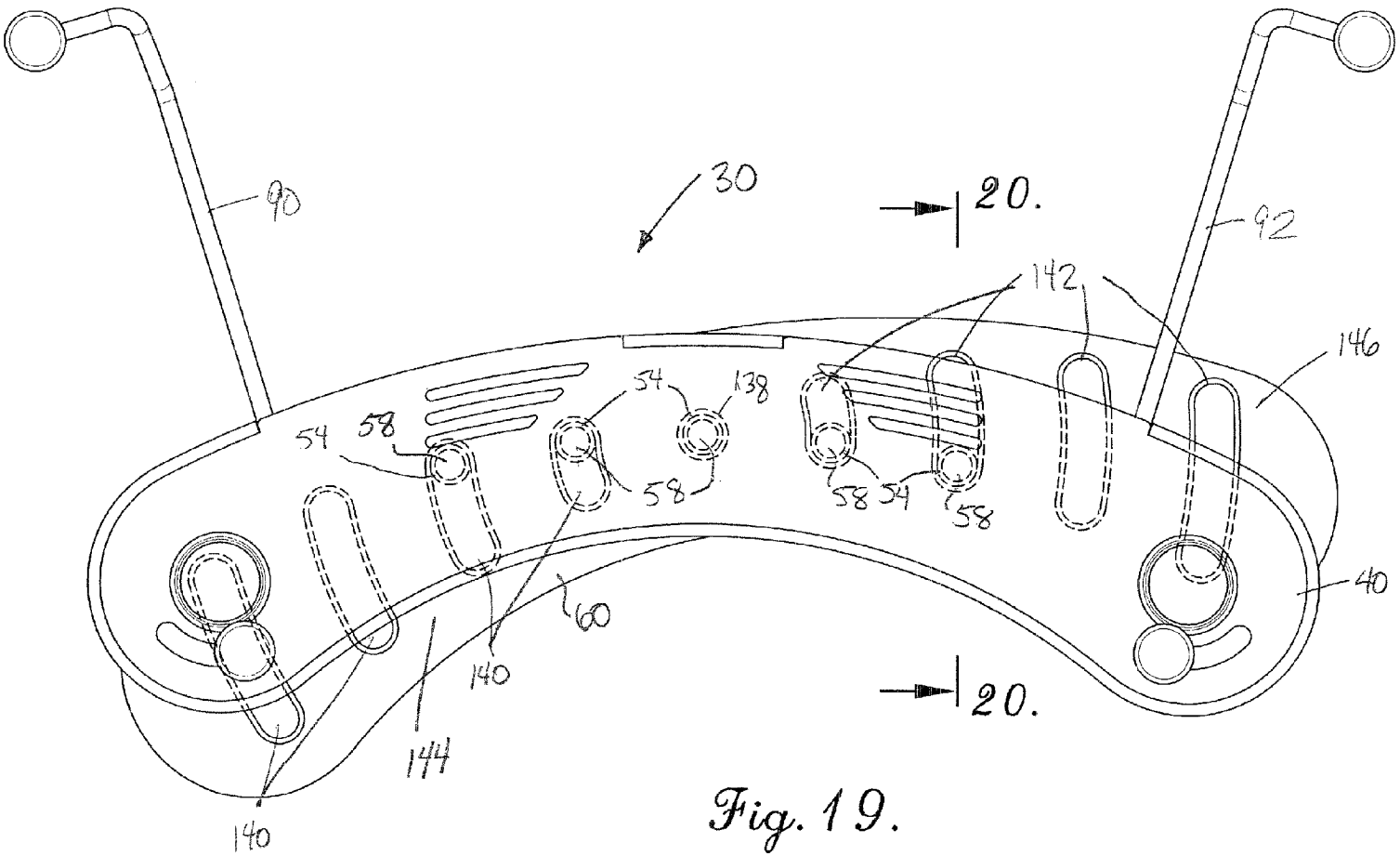
FIG. 19 is a plan view of the shoulder cradle as shown in FIG. 18, showing the provision of arcuate slots in the shoe, in part in broken lines, for enabling pivotal movement, and studs and magnets in broken lines for coupling the shoe to the foundation.

The foundation 42 includes the receiver 52, ferromagnetic plate 50 and cushion 49. The cushion is made of resilient foam or other material which is shaped to ergonomically conform to the shoulder of the violin player on its bottom side. The ferromagnetic plate 50 is preferably made of iron, steel or other metal or alloy which is capable of magnetic attraction and coupling with magnets 58. Alternatively, the ferromagnetic plate 50 can be made of magnetic material, and the magnets 58 be of ferromagnetic material capable of magnetic attraction and coupling. The receiver 52 is preferably bonded or mechanically attached to the ferromagnetic plate 50 and the cushion 49 is preferably bonded or mechanically attached within the receiver 52, with the sidewall 126 supporting the cushion 49. In this way, the foundation 42 is shifted as a unit when adjusted on the base 40. The tubes 56 in the receiver preferably are sized to snugly and releasably receive therein the studs 54 and are arranged in a grid pattern or matrix 128 (shown in the drawings with three longitudinally extending columns of tubes 56 and nine transversely extending rows of tubes 56) where the rows are in linear alignment and the columns are arranged in a slightly arcuate pattern so as to provide a matrix 128 as shown, for example, in FIG. 10. The matrix 128 arranges the tubes so as to be complemental to the spacing and arrangement of the studs 54. That is, the arrangement 122 of the studs 54 permits the mounting plate 48 to not only be coupled to the receiver 52 with the studs 54 received in the tubes 56 and the magnets 58 sufficiently proximate to the ferromagnetic plate 50 to be in magnetic coupling relationship in a centered position as shown in FIGS. 4, 5, 10 and 11, but also for the mounting plate 48 to be detached and remounted in a shifted position both transversely relative to the receiver 52 as shown in FIGS. 12, 13 and 14, and longitudinally relative to the receiver 52 as shown in FIGS. 15, 16 and 17. Because the configuration of the cradle 30 when viewed in plan is generally arcuate, the columns of the matrix 128 are also arcuate whereby such longitudinal shifting generally maintains alignment between the base 40 and the foundation 42 of the cradle 30. The shoe 60 can be omitted when pivoting is not desired, as illustrated in FIGS. 4, 5, and 10 through 17.

Figure 5:
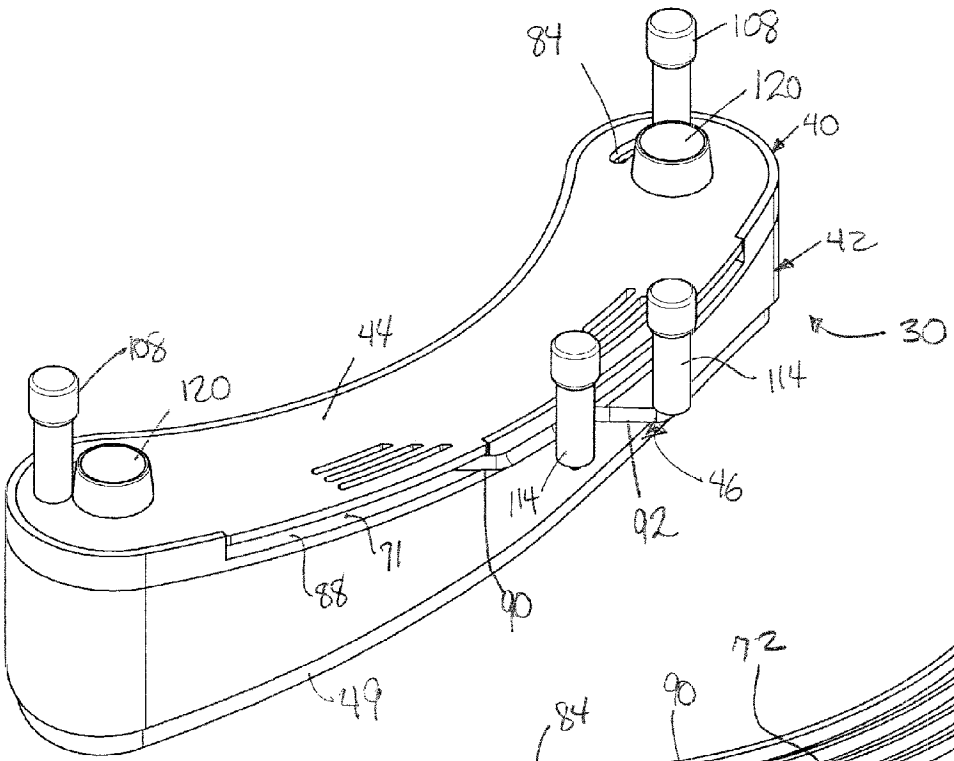
FIG. 5 is a perspective view showing the legs of the coupling structure retracted into a storage position.
Figure 6:
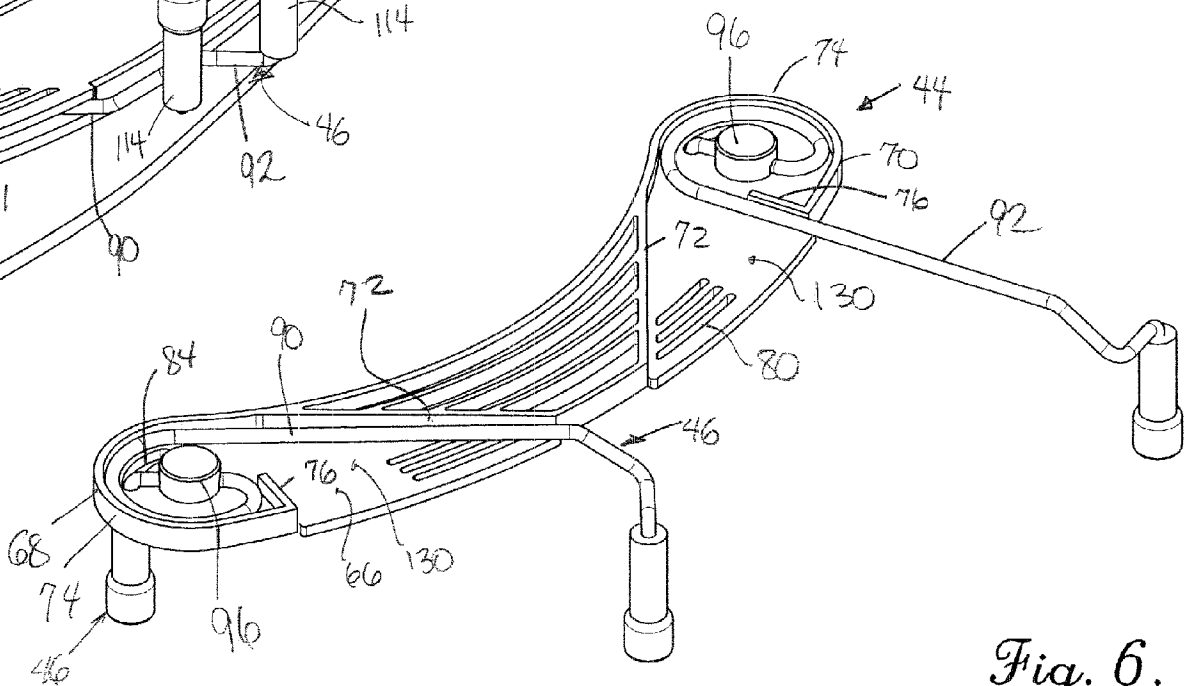
FIG. 6 is a bottom perspective view of the base plate and legs for coupling the shoulder cradle hereof to a violin, structure with the mounting plate removed to show the leg and base plate having internal walls within defining the outer limit of a range of pivoting of the legs.
Figure 7:
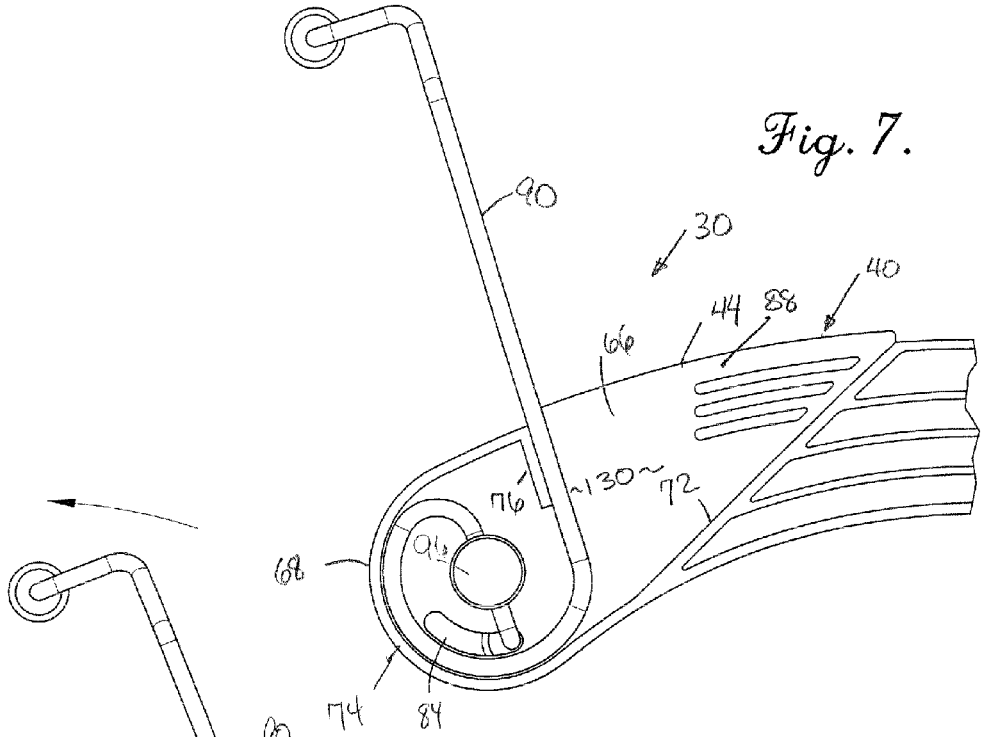
FIG. 7 is an enlarged, fragmentary view of the coupling structure with the mounting plate removed to show the mounting legs pivoted to a violin-receiving position.
Figure 8:
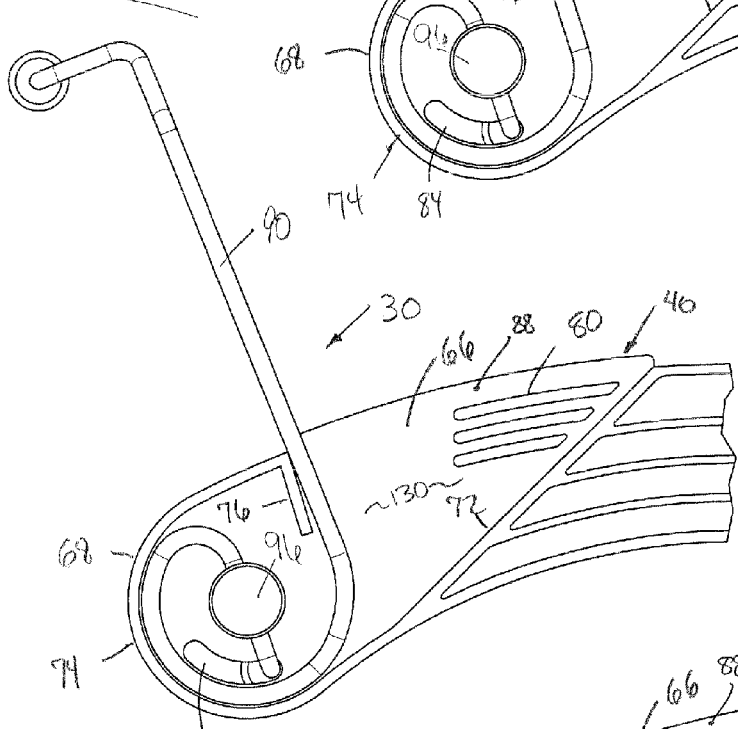
FIG. 8 is an enlarged, fragmentary view similar to FIG. 7 but showing one of the legs biased in a counterclockwise direction against an internal wall of the mounting plate for mounting to and gripping a violin body.
Figure 9:
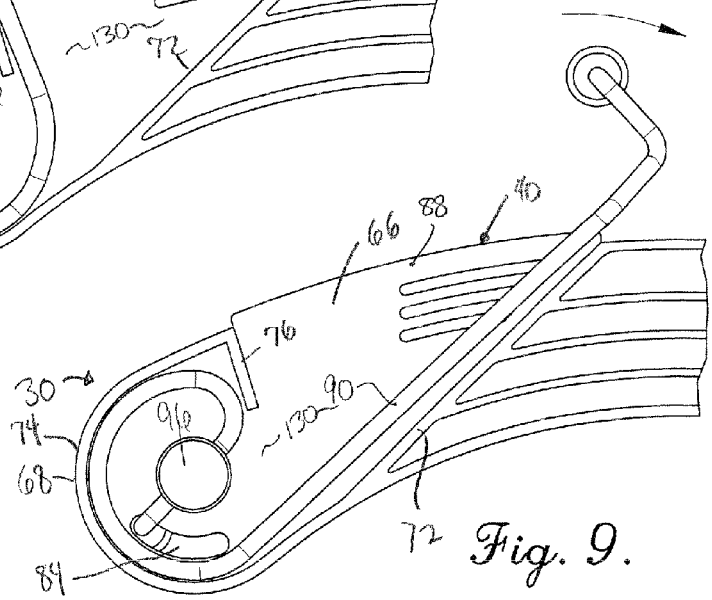
FIG. 9 is an enlarged, fragmentary view similar to FIGS. 7 and 8, but showing one of the legs pivoted into a storage position.

In storage, the legs 90 and 92 may be pivoted into the position shown in FIGS. 5 and 9, with the majority of the legs including the majority of the second straight sections 94 positioned in respective sector shaped cavities 130 between the diagonal walls 72 and the inner walls 76. This permits compact storage of the cradle 30 in restricted areas such as a carrying case for a violin. In use, the legs 90 and 92 together with their respective pivot mounts 96 are pivoted away from each other (i.e., one leg 90 (the left leg as seen in FIG. 10) is pivoted counterclockwise, while the other (right) leg 92 is pivoted clockwise) until limited by the extent of the arcuate slots 84 and/or engagement of the second straight sections with the inner walls 76, as shown in FIG. 7. In order to clamp the cradle 30 to the violin 32, the legs 90 and 92 are spread further apart as shown in FIG. 8, whereby the resiliency of the legs 90 and 92 causes the legs to exert a biasing force urging the guards 108 and 114 of the respective legs against the body of the violin 32, and preferably with the bumpers 120 resting against the violin body 36.

Because violin players may have many different styles or body configurations, the cradle 30 hereof has an adjustment feature that permits the base 40 which is coupled to the violin 32 to be detached and shifted relative to the foundation 42 which rests upon the shoulder of the violinist. The base 40 is coupled to the foundation 42 by the snug fit of the studs 54 into the corresponding tubes 56 of the receiver, and further by the magnetic attraction between the magnets 58 and the ferromagnetic plate 50 of the foundation 42. The mounting plate may be detached from the receiver by physical separation, wherein the studs 54 are lifted out of their tubes 56. The mounting plate 48, and thus the base 40, may be readjusted for greater comfort or performance of the violinist by moving the array either transversely relative to the arcuate longitudinal axis of the foundation 42, longitudinally relative to foundation 42, or both transversely and longitudinally as described above. While magnets 58 are preferably used to retain and strengthen the connection between the base and the foundation, it is to be understood that the use of one or more magnets mounted to the base and the ferromagnetic plate in the foundation provides sufficient magnetic coupling that in some applications of the present invention, the studs of the mounting plate and corresponding tubes in the receiver may not be necessary to provide the adjustable coupling between the foundation and the base contemplated herein.

Additionally, as shown in FIGS. 2, 3, 18, 19 and 20, the violinist may want to use the shoe 60 to provide the ability of the violin 32 to pivot while the cradle 30 remains positioned with the cushion 49 resting on the violinist's shoulder. The shoe 60 may be formed of a variety of materials, preferably synthetic resin, and includes a top surface 132 best seen in FIG. 2, and a bottom surface 134 best seen in FIG. 3. The pegs 62 are sized and positioned on the shoe preferably the same as the arrangement of the studs 54 on the mounting plate 48, and extend downwardly from the bottom surface 134 for receipt in the tubes 56 of the receiver 52. The pegs 62 include sockets 136 for receiving magnets 64 therein. The top surface 132 includes a central depression 138 sized to fit one of the studs 54, and a plurality of arcuate depressions 140 and 142. The arcuate depressions 140 and 142 are progressively greater in length as their distance from central depression 136 increases. Additionally, the arcuate depressions 140 on one side 144 of the top surface 132 are mirrored with the arcuate depressions 142 on the second side 146 of the top surface 134. The arcuate depressions 140 and 142 are sized to receive respective ones of studs 54 therein, and to permit the respective studs to glide along an arcuate path defined by the arcuate depressions and to pivot around an axis defined by the central depression.

When in use, the shoe 60 is positioned between the receiver 52 of the foundation 42 and the mounting plate 48 of the base, with the pegs 62 and their magnets 64 in selected ones of the tubes 56 so that the magnets are in proximity to the ferromagnetic plate 50. Because the configuration and spacing of the pegs 62 is the same as that of the studs 54, the shoe 60 may be longitudinally or laterally shifted from a centered position shown in FIGS. 18 to 20, to a laterally offset position such as illustrated in FIG. 13, or a longitudinally offset position as shown in FIG. 16, or both. Additionally, in preferred embodiments where the number of arcuate recesses 140 and 142 are, in total, greater than the number of studs 54 in the mounting plate 48, the pivot point (defined by which stud 54 is inserted into the central depression 136) of the mounting plate 48 can be shifted longitudinally to adjust the pivoting position more comfortably to the violinist. The use of magnets 58 and 64 helps to retain the base 40, foundation 42 and shoe 60 against separation, but does not significantly inhibiting the transverse movement of the base and shoe relative to the foundation because the magnets are essentially sliding across the magnetic field between the magnets and the ferromagnetic plate rather than moving away from the ferromagnetic plate 50.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A violin shoulder cradle comprising:

a body adapted for positioning between a violin and the shoulder of a musician; and coupling structure mounted on the body and adapted for clamping to a violin, wherein said body includes a foundation having a cushion;

a base supporting said coupling structure; and attachment structure connecting said base and said foundation in order to permit selective attachment of said base and said foundation in different relative positions, said attachment structure including a first plurality of spaced apart studs arranged in a preselected spacing on one of said base and foundation, and a second plurality of spaced apart tubes arranged in a preselected spacing on the other of said base and foundation, each of said tubes being configured to receive one of said studs therein and the preselected spacing of said tubes being complemental to the preselected spacing of said studs to permit attachment of said base and foundation at a first one of said different relative positions with a number of said first plurality of studs being detachably received within a corresponding number of said tubes whereby a plurality of said number of said first plurality of studs are removable from said corresponding number of said second plurality of spaced apart tubes and enabling said foundation to be reattached to said base at a different, second one of said different relative positions with at least some of said number of first plurality of studs detachably received in others of said second plurality of spaced apart tubes.

2. A violin shoulder cradle as set forth in claim 1, said body being elongated, said first plurality of studs being equal in number to said second plurality of tubes, wherein said studs and tubes are each arranged in a corresponding matrix of columns generally along the length of the body and in corresponding rows transverse to said columns.

3. A violin shoulder cradle comprising:

a body adapted for positioning between a violin and the shoulder of a musician; and coupling structure mounted on the body and adapted for clamping to a violin, wherein said body includes a foundation having a cushion, and a base to which said coupling structure is mounted, and attachment structure connecting said base and said foundation and permitting selective attachment of said base and said foundation in a plurality of different relative positions, wherein said attachment structure includes a plurality of magnets mounted on one of said base and foundation in spaced-apart relationship defining a plurality of spaced apart preselected retention locations, and the other of said base and foundation includes a ferromagnetic member which, when positioned in proximity to said at least one magnet, provides for retention of said base to said foundation whereby said foundation is removable from said base and reattachable at an alternate one of said different relative positions even when one of said plurality of magnets is not in opposition to and magnetically coupled to said ferromagnetic member.

4. A violin shoulder cradle as set forth in claim 3, wherein said one of said base and foundation includes a plurality of studs and the other of said base and foundation includes a plurality of tubes complementally configured to releasably receive said studs therein.

5. A violin shoulder cradle as set forth in claim 4, wherein at least one of said studs includes an opening receiving one of said plurality of magnets therein.

6. A violin shoulder cradle as set forth in claim 5, wherein said plurality of tubes is arranged in a matrix of rows and columns, and whereby the matrix is arranged to permit said at least one of said studs to be removed and repositioned in an alternate one of said tubes with said one of said plurality of magnets proximate to the ferromagnetic member when repositioned in said alternate one of said tubes.

7. A violin shoulder cradle comprising:

a body adapted for positioning between a violin and the shoulder of a musician;

coupling structure mounted on the body and adapted for clamping to a violin;

wherein said body includes a foundation including a shoulder-engaging cushion, and a base supporting said coupling structure; and a pivot member coupling said foundation and said base for permitting pivoting of said foundation relative to said base about an upright axis while the cushion remains on the musician's shoulder during playing of the violin, wherein said pivot member includes a shoe having a depression therein adapted to receive a stud positioned on one of said foundation and said base, said depression being configured to limit pivoting of the base and coupling structure to said upright axis defined by said stud received in said depression, and wherein said shoe includes a central depression and a plurality of arcuate depressions, and wherein one of said foundation and said base includes a plurality of studs, one of said studs being received in said central depression and at least another of said studs being received in one of said arcuate depressions for shiftable movement therein.

8. A violin shoulder cradle as set forth in claim 7, wherein said shoe includes a plurality of pegs, and the other of said foundation and said base includes a plurality of tubes configured for removably receiving said pegs in selected ones of said tubes.

9. A violin shoulder cradle as set forth in claim 7, wherein said pivot member includes a shoe having a magnet, and wherein at least one of said base and said foundation includes a ferromagnetic member for magnetically coupling said shoe thereto.

10. A violin shoulder cradle as set forth in claim 9, wherein:

said shoe includes a plurality of pegs, and wherein a magnet is mounted to at least some of said pegs, said shoe including a central depression and a plurality of arcuate depressions positioned on opposite sides of said central depression;

at least one of said base and said shoe includes a plurality of studs sized and arranged for receipt in selected ones of said central depression and said arcuate depressions; and the other of said base and shoe including a plurality of tubes arranged in rows and columns sized and arranged in a matrix for selective and alternate removable receipt of said pegs therein.

* * * * *